US007153156B1

(12) United States Patent
Malstrom

(10) Patent No.: US 7,153,156 B1
(45) Date of Patent: Dec. 26, 2006

(54) COAXIAL CABLE CONNECTOR

(75) Inventor: Charles Randall Malstrom, Lebanon, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/434,088

(22) Filed: May 15, 2006

(51) Int. Cl.
*H01R 4/24* (2006.01)

(52) U.S. Cl. ..... 439/394; 439/395

(58) Field of Classification Search ..... 439/394, 439/395, 578, 610, 406, 407
See application file for complete search history.

(56) References Cited

U.S. PATENT DOCUMENTS 4,708,414 A * 11/1987 Lam ..... 439/394
4,927,378 A * 5/1990 Song ..... 439/394
5,314,350 A * 5/1994 Matthews et al. ..... 439/404
5,399,106 A * 3/1995 Ferry ..... 439/620.09
5,924,887 A * 7/1999 Aoyama et al. ..... 439/400
6,142,817 A * 11/2000 Lee ..... 439/395
6,666,706 B1 * 12/2003 Jones et al. ..... 439/405
6,746,268 B1 6/2004 Laub et al.
6,758,695 B1 * 7/2004 Pepe et al. ..... 439/608
2003/0104720 A1 * 6/2003 Laub et al. ..... 439/394

* cited by examiner

*Primary Examiner*—Tulsidas C. Patel
*Assistant Examiner*—Harshad C Patel

(57) ABSTRACT

A connector for a coaxial cable having a braid layer includes a housing and a shield configured to receive the housing. An insulation displacement contact (IDC) is formed on the shield. The IDC includes a contact wall and a prong. The contact wall defines and extends along a contact wall plane. The prong is displaced laterally out of the contact wall plane. An edge of the contact wall and an edge of the prong define a gap therebetween that is sized to receive a braid wire of the cable.

14 Claims, 4 Drawing Sheets

COAXIAL CABLE CONNECTOR

BACKGROUND OF THE INVENTION

The invention relates generally to coaxial cable connectors, and more particularly to coaxial cable connectors having insulation displacement contacts suitable for use with smaller diameter coaxial cables.

In the past, connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, it is preferable that the impedance remain matched through the interconnection.

Today, coaxial cables are widely used. Recently, demand has risen for radio frequency (RF) coaxial cables in applications such as personal computers and wireless networks. In addition, there is an increased demand for RF coaxial cables in the automotive industry, which is due, in part, to the increased electrical content within automobiles, such cellular phones, GPS, satellite radios, Bluetooth® compatibility systems and the like. The wide applicability of coaxial cables demands that connected coaxial cables maintain the impedance at the interconnection.

Conventional coaxial connector assemblies include matable plug and receptacle housings carrying dielectric subassemblies. The dielectric subassemblies include dielectrics, metal outer shields, and center contacts. The dielectric subassemblies receive and retain coaxial cable ends, and each of the outer shields enclose the dielectrics on three sides thereof. Portions of the shields pierce the cable jackets to electrically contact the cable braids while the center contacts engage the central conductors. The plug and receptacle housings include interior latches that catch and hold the dielectric subassemblies, and thus the coaxial cable ends, therein. When the plug and receptacle housings are mated, the dielectric subassemblies are engaged such that the outer shields are interconnected and the center contacts are interconnected with the dielectrics interconnected therebetween.

Some of the shields that pierce the cable jackets are formed with insulation displacement contacts (IDC) to make terminations to the cable braids. The IDC pierces the coaxial cable in a manner that captures and wedges the braid wires in a slot in the IDC. However, there is a practical limit as to how small the IDC slots can be made using current stamping processes. With some of today's smaller coaxial cables, the braid wires are so small that a reliable electrical connection cannot be made using conventional IDC contacts with stamped slots. Thus, there is a need for a cost effective contact that can be used with smaller diameter coaxial cables with smaller diameter braid wires.

BRIEF DESCRIPTION OF THE INVENTION

In one aspect, an electrical connector for a coaxial cable having a braid layer is provided. The connector includes a housing and a shield configured to receive the housing. An insulation displacement contact (IDC) is formed on the shield. The IDC includes a contact wall and a prong. The contact wall defines and extends along a contact wall plane.

The prong is displaced laterally out of the contact wall plane. An edge of the contact wall and an edge of the prong define a gap therebetween that is sized to receive a braid wire of the cable.

Optionally, the IDC is unitarily formed with the shield and the prong extends from the back wall. The prong includes a tip and a tapered edge configured to pierce an insulation layer and the braid layer of the cable. The prong includes a first bend and a second bend. The first and second bends determine an angular relationship between the prong and the contact wall.

In another aspect, a shield for a coaxial cable having a braid layer is provided. The shield includes a back wall and an insulation displacement contact (IDC) formed on the back wall. The IDC includes a contact wall and a prong. The prong is displaced out of a plane of the contact wall. An edge of the contact wall and an edge of the prong define a gap sized to receive a braid wire of the cable. The braid wire is deflected laterally around the prong when the braid wire is received in the gap.

In yet another aspect, a shield for a coaxial cable having a braid layer includes a back wall and an insulation displacement contact (IDC) formed on the back wall. The IDC includes a contact wall and a prong. The prong is displaced out of a plane of the contact wall. An edge of the contact wall and an edge of the prong define a gap sized to receive a braid wire of the cable. The contact wall edge is located on a forward surface of the contact wall and the edge of the prong is located on a rearward surface of the prong.

DETAILED DESCRIPTION OF THE INVENTION

Figure 1:
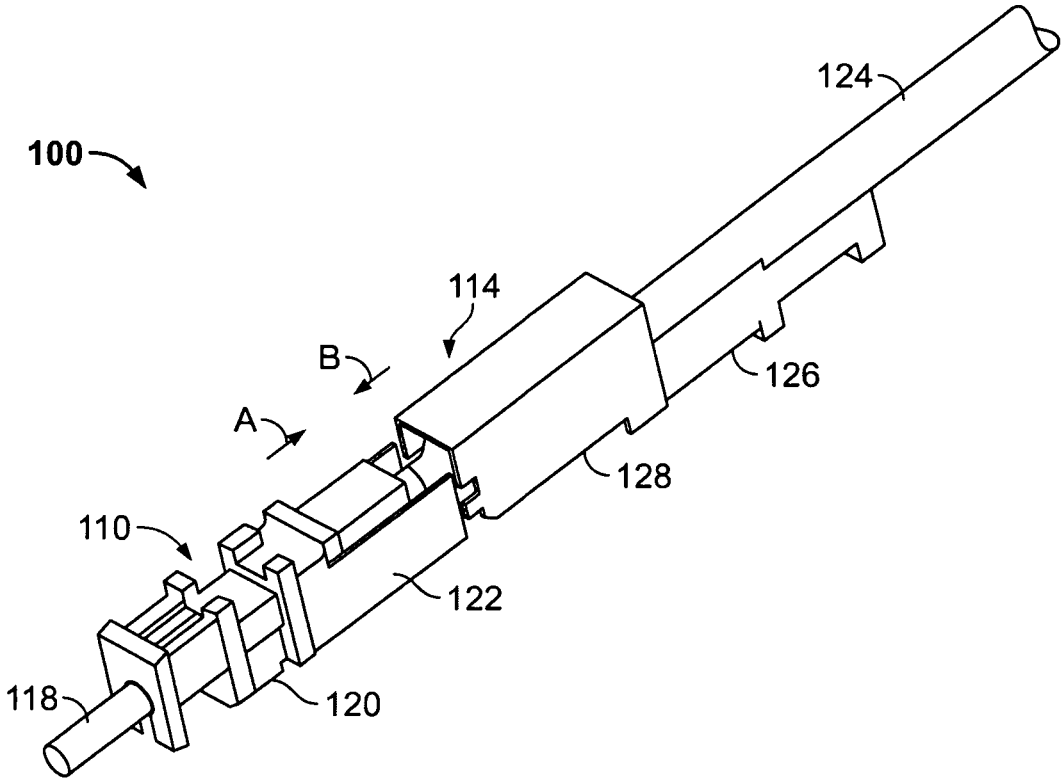
FIG. 1 is a perspective view of a matable connector assembly formed in accordance with an exemplary embodiment of the present invention.

FIG. 1 illustrates a coaxial cable connector assembly 100 formed in accordance with an exemplary embodiment of the present invention. The assembly 100 includes a receptacle connector 110 and a plug connector 114 that are configured to be mated with one another. In FIG. 1, connectors 110 and 114 are shown in an unmated condition and may be mated by moving the connectors 110 and 114 as indicated by the arrows A and B.

Receptacle connector 110 is terminated to a cable 118 and includes a dielectric housing 120 that is received in a shield 122. Plug connector 114 is terminated to a cable 124 and includes a dielectric housing 126 that is received in a shield 128. Housing 120 holds a contact (not shown) that is joined to center conductor (not shown) in cable 118. Likewise, housing 126 holds a contact (not shown) that is joined to center conductor (not shown) in cable 124. Shields 122 and 128 are electrically terminated to braids in cables 118 and 124, respectfully. Shield 122 surrounds a substantial portion of a perimeter of housing 120. Similarly, shield 128 surrounds a substantial portion of a perimeter of housing 126. When receptacle connector 110 and plug connector 114 are mated, shield 122 is received in shield 128 such that the shields 122 and 128 cooperate to form a substantially shielded chamber (not shown) enclosing a substantial portion of both housings 120 and 126. As shown in FIG. 1, connectors 110 and 114 are configured to electrically connect coaxial cables 118 and 124 which may differ in size or diameter. In other embodiments, one of connectors may be connected to a circuit board, an electrical component, or a non-coaxial cable and the like. Cable 118 is sufficiently small, with braid wires being correspondingly small, that special consideration is given to the shield-to-braid layer connection, as will be described.

Figure 2:
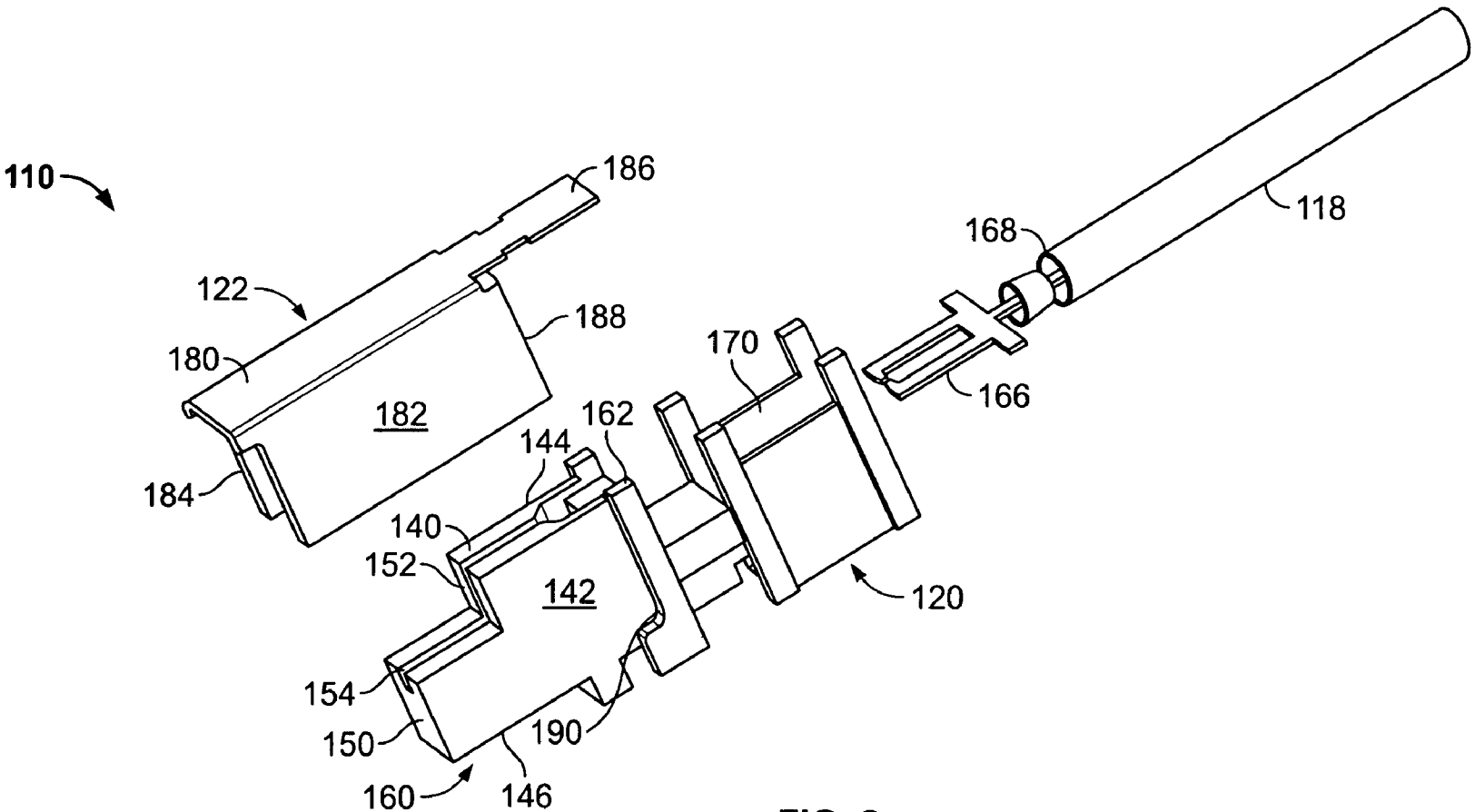
FIG. 2 is an exploded view of the receptacle connector shown in FIG. 1.

FIG. 2 illustrates an exploded view of receptacle connector 110. Housing 120 is formed from a dielectric material of a thickness determined to provide a desired impedance through the connector 110. Housing 120 includes a top wall 140, side walls 142 and 144, and a bottom wall 146. Housing 120 also includes a mating face 150 having a stepped portion 152. A slot 154 extends from mating face 150 rearward through a forward section 160 of housing 120 to a larger cavity 162. A blade contact 166 is mounted on an end 168 of cable 118. Slot 154 and cavity 162 collectively receive blade contact 166 and end 168 of cable 118. A channel 170 is provided to support a length of cable 118. Shield 122 includes a top 180 and sides 182 and 184. Top 180 includes a rearward extension 186. A back wall 188 of shield 122 is received in a slot 190 in housing 120.

Figure 3:
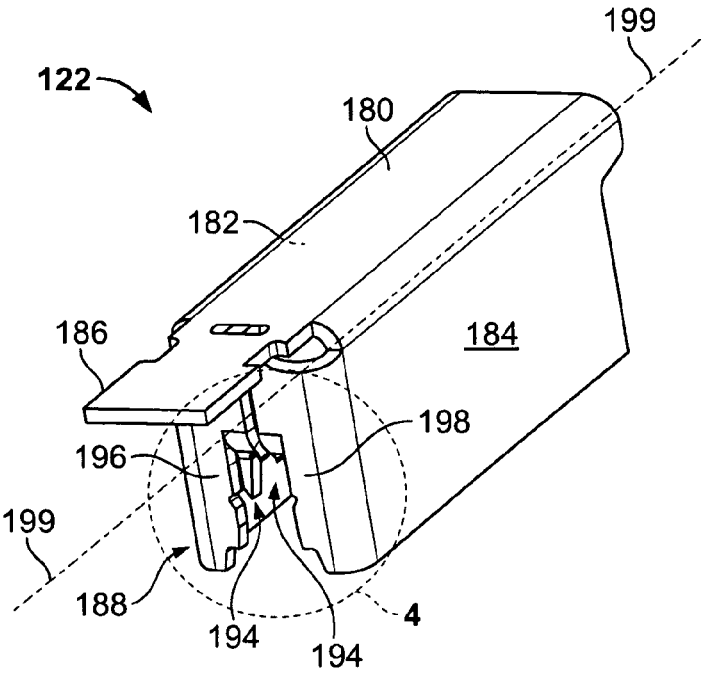
FIG. 3 is a perspective view of a connector shield including an IDC contact formed in accordance with an exemplary embodiment of the present invention.

FIG. 3 illustrates a rear perspective view of shield 122. Shield 122 is formed from a conductive material and is terminated to the braid of coaxial cable 118 (FIG. 2). The termination to the braid is accomplished with insulation displacement contacts (IDC) 194 formed on back wall 188 of shield 122. In an exemplary embodiment, shield 122 is a unitary structure formed from a single sheet of metallic material and has a rectangular shape extending along a longitudinal axis 199. Back wall 188 comprises a left half 196 and a right half 198 that are extensions of sides 182 and 184 respectively that are bent or folded to form back wall 188. The left half 196 and right half 198 each include an IDC 194 and are oriented perpendicular to the longitudinal axis 199. In an exemplary embodiment, back wall 188 includes a pair of IDC's 194. It is to be understood, however, that in other embodiments, more than two IDC's may be used.

Figure 4:
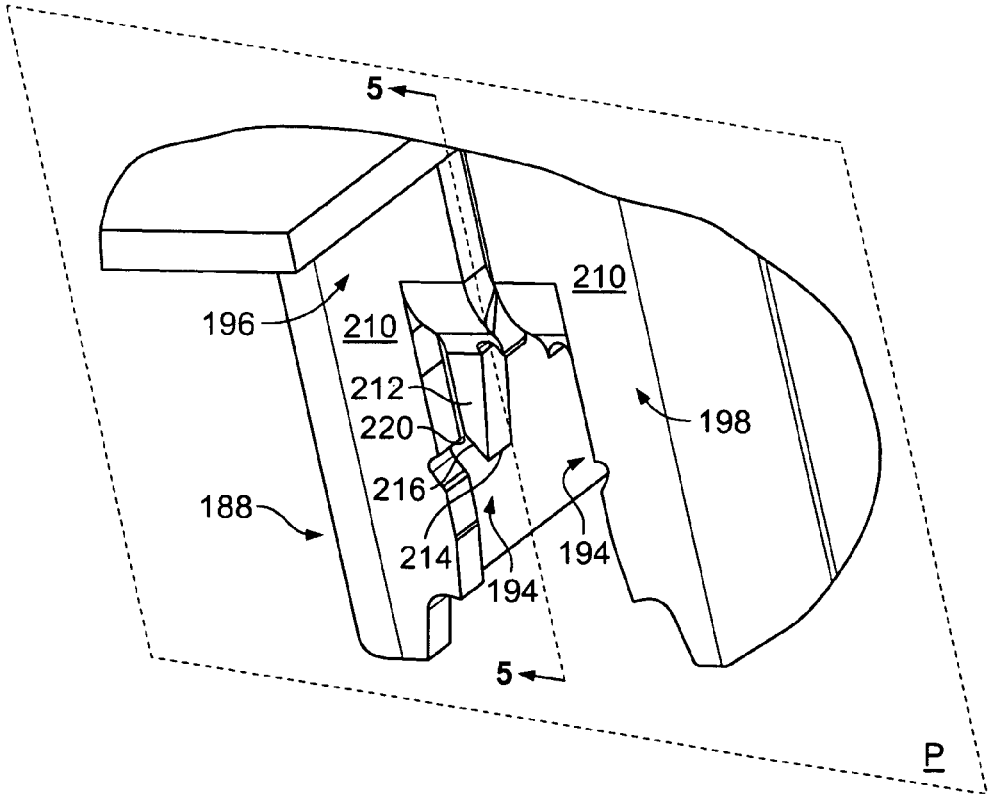
FIG. 4 is an enlarged fragmentary view of a portion of the connector shield shown in FIG. 3.

FIG. 4 illustrates an enlarged view of back wall 188 including one of the IDC's 194. IDC 194 may be fabricated to make braid terminations in coaxial cables of any size, including smaller cables such as cable 118 which, for example, may have a diameter of less than 2 mm, such as 1.38 mm. Each IDC 194 includes a contact wall 210 and a prong 212. While only one prong 212 is visible in FIG. 4, it is understood that both walls 210 include prongs 212. Each prong 212 includes a tip 214 and a tapered edge 216. The back wall 188 and contact walls 210 lie in a common contact wall plane P (denoted in dashed lines). Prongs 212 are positioned to be located outside of and displaced laterally from the plane P. A gap 220 is formed between prong 212 and contact wall 210. Tip 214 and tapered edge 216 are configured to pierce the insulation and braid layer of a coaxial cable. Tapered edge 216 is configured to guide braid wires into gap 220. Braid wires are wedged in and securely held in gap 220.

Figure 5:
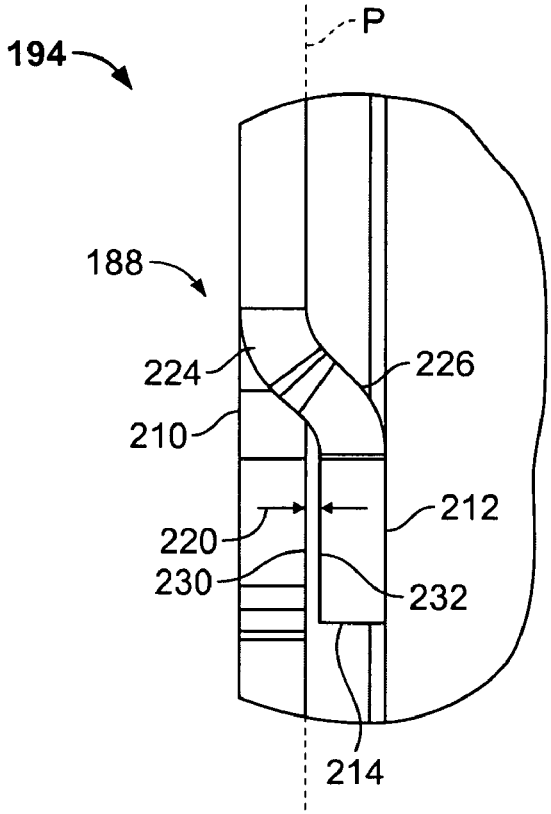
FIG. 5 is an enlarged side view of the IDC contact shown in FIG. 4 taken along sight line 5—5.

FIG. 5 illustrates a side view of one IDC 194. FIG. 5 illustrates the plane P as a single line where the plane P extends out of, and perpendicular to the surface of the drawing sheet. The prong 212 is positioned adjacent to, but displaced laterally from, the contact wall 210 and plane P. IDC 194 is formed with a first bend 224 and a second bend 226 that position the prong 212 laterally from the contact wall 210. Contact wall 210 has a forward edge 230, while prong 212 has a rearward edge 232 that is located adjacent to the contact wall forward edge 230 when prong 212 is displaced out of plane P. Gap 220 may be measured by the distance between contact wall forward edge 230 and prong rearward edge 232. In FIG. 5, prong 212 is shown being parallel to contact wall 210. In other embodiments, prong 212 and contact wall 210 may not be parallel.

In an exemplary embodiment, back wall 188 is cut using a lancing or shearing operation to form the prong 212. When first formed, the prong 212 lies in the contact wall plane P, adjacent the contact wall 210. First and second bends 224 and 226, respectively, are applied to move prong 212 out of the contact wall plane P and create the gap 220. Gap 220 is sized to receive the braid wires of the coaxial cable being used. In one embodiment, the gap 220 is about 0.06 mm where IDC 194 is suitable for use with coaxial cables of 1.38 mm in diameter. Prong 212 may be formed with a slight angle relative to contact wall 210 to provide a lead-in for the cable insulation and braid wires. First bend 224 and second bend 226 cooperate to determine the angular relationship between prong 212 and contact wall 210. IDC 194 may be fabricated for use with any commonly used coaxial cable size.

Figure 6:
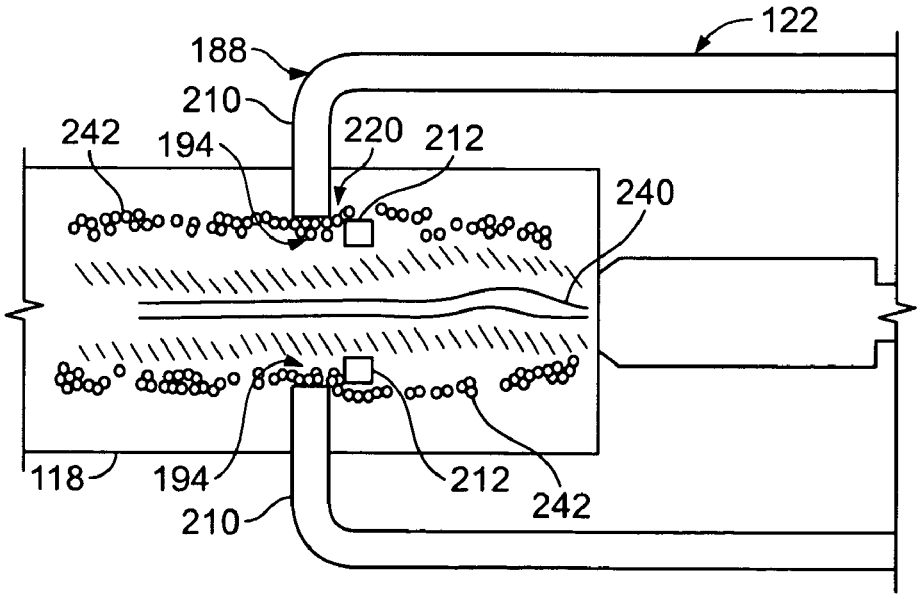
FIG. 6 is a schematic view of a coaxial cable in use with the IDC shown in FIG. 4.

FIG. 6 is a schematic view of coaxial cable 118 in use with shield 122 and IDC's 194. As shown in FIG. 6, cable 118 has a center conductor 240 and a braid 242. Cable 118 is inserted in shield 122 and shield 122 is terminated to braid 242 at IDC's 194. Prongs 212 are out of plane with contact walls 210. Braid wires 242 are captured and deflected laterally around prongs 212 and are wedged in gaps 220. In an exemplary embodiment, gaps 220 are sized so that prongs 212 apply a retention force on braid wires 242.

The embodiments thus described provide a cost effective and reliable IDC contact 194 for making braid terminations with coaxial cables. While the contact may be used with any common coaxial cable size or diameter, the contact is particularly useful with small diameter coaxial cables having correspondingly small diameter braid wires. The IDC pierces the coaxial cable 118 in a manner that deflects the braid wires laterally and wedges the braid wires in the gap between the contact wall 210 and the contact prong 212.

While the invention has been described in terms of various specific embodiments, those skilled in the art will recognize that the invention can be practiced with modification within the spirit and scope of the claims.

What is claimed is:

1. An electrical connector for a coaxial cable having a braid layer, said connector comprising:

a housing;

a shield configured to receive said housing; and an insulation displacement contact (IDC) formed on said shield, said IDC comprising a contact wall and a prong, said contact wall defining and extending along a contact wall plane, said prong being displaced laterally out of said contact wall plane, and wherein an edge of said contact wall and an edge of said prong define a gap therebetween that is sized to receive a braid wire of the cable.

2. The connector of claim 1, wherein said IDC is unitarily formed with said shield.

3. The connector of claim 1, wherein said shield includes a back wall and said prong extends from said back wall.

4. The connector of claim 1, wherein said prong includes a tip and a tapered edge configured to pierce an insulation layer and the braid layer of the cable.

5. The connector of claim 1, wherein said prong includes a first bend and a second bend, said first and second bends determining an angular relationship between said prong and said contact wall.

6. The connector of claim 1, wherein said shield includes a back wall and said prong is formed by shearing said back wall and applying first and second bends to separate said prong from said contact wall.

7. The connector of claim 1, wherein said prong applies a retention force on the braid wires.

8. A shield for a coaxial cable having a braid layer, said shield comprising:

a back wall; and an insulation displacement contact (IDC) formed on said back wall, said IDC comprising a contact wall and a prong, said contact wall defining and extending along a contact wall plane, said prong being displaced laterally out of said contact wall plane, and wherein an edge of said contact wall and an edge of said prong define a gap therebetween that is sized to receive a braid wire of the cable.

9. The shield of claim 8, wherein the braid wire is deflected laterally around said prong when the braid wire is received in said gap.

10. The shield of claim 8, wherein said prong includes a tip and a tapered edge configured to pierce an insulation layer and the braid layer of the cable.

11. The shield of claim 8, wherein said prong includes a first bend and a second bend, said first and second bends determining an angular relationship between said prong and said contact wall.

12. The shield of claim 8, wherein said prong is formed by shearing said back wall and applying first and second bends to separate said prong from said contact wall.

13. The shield of claim 8, wherein said prong applies a retention force on the braid wires.

14. The shield of claim 8, wherein said contact wall edge is located on a forward surface of said contact wall and said edge of said prong is located on a rearward surface of said prong.

* * * * *